United States Patent [19]

Hukuhara

[11] 4,456,051

[45] Jun. 26, 1984

[54] SCROLL MANUFACTURING METHOD

[75] Inventor: Seiichi Hukuhara, Takasaki, Japan

[73] Assignee: Sanden Corporation, Gunma, Japan

[21] Appl. No.: 353,830

[22] Filed: Mar. 2, 1982

[30] Foreign Application Priority Data

Mar. 2, 1981 [JP] Japan ..... 56-28312

[51] Int. Cl.[3] ..... B22D 25/02

[52] U.S. Cl. ..... 164/131; 164/137; 164/340; 164/341; 164/344

[58] Field of Search ..... 418/55; 164/131, 137, 164/339–341, 344–345

[56] References Cited

U.S. PATENT DOCUMENTS

| | | | |
|---|---|---|---|
| 801,182 | 10/1905 | Creux | 418/55 |
| 1,527,807 | 6/1924 | Loguin | 418/55 |
| 3,279,005 | 10/1966 | Wehmeyer | 164/137 |

*Primary Examiner*—Gus T. Hampilos
*Assistant Examiner*—Richard K. Seidel
*Attorney, Agent, or Firm*—Banner, Birch, McKie & Beckett

[57] ABSTRACT

A method for manufacturing a scroll for use in a scroll type fluid displacement apparatus is disclosed. The method comprises the steps of:

(a) providing a molding member having two involute grooves, a first of said grooves having a wedge-shaped axial configuration, and a second of said grooves having a generally rectangular-shaped axial cross-sectional configuration;

(b) inserting a mating wedge-shaped insertion member into said first involute groove to fill the space within said first groove;

(c) covering the open end of said first and second grooves with a second molding member, said second molding member having an indentation facing and in communication with said open end of said grooves;

(d) filling the space of said second involute groove and said indentation with molten metal to form the molten metal into the shape of the spiral element of the scroll within said space of said second involute groove and into the shape of the end plate of the scroll within the space of said indentation; and (e) removing said insertion member from said first groove and removing said scroll formed in said second groove and said indentation from said first molding member.

A manufacturing tool for use in the method is also disclosed.

7 Claims, 6 Drawing Figures

SCROLL MANUFACTURING METHOD

BACKGROUND OF THE INVENTION

This invention relates to a scroll type fluid displacement apparatus, and more particularly to a method for manufacturing the scroll.

Scroll type fluid displacement apparatus are well known in the prior art. For example, U.S. Pat. No. 801,182 discloses a device including two scrolls each having a circular end plate and spiroidal wrap or involute spiral element. Both scrolls are maintained at an angular and radial offset so that both spiral elements interfit at a plurality of line contacts between their spiral curved surfaces to thereby seal off and define at least one pair of fluid pockets. The relative orbial motion of the scrolls shifts the line contacts along the spiral curved surfaces to change the volume of the fluid pockets. The volume of the fluid pockets increases or decreases dependent on the direction of the orbital motion. Therefore, scroll type fluid displacement apparatus are applicable to compress, expand or pump fluids.

FIG. 1 illustrates a basic design of a scroll suitable for use in a scroll type fluid displacement apparatus. Scroll 1 includes a circular end plate 2 and a wrap or involute spiral element 3 affixed to or extending from one side surface of end plate 2. A scroll type fluid displacement apparatus includes a pair of such scrolls, both of which are maintained at an angular and radial offset so that they interfit and form a plurality of line contacts and axial contact to define at least one pair of sealed off fluid pockets. In such apparatus, each sealed off fluid pocket is defined by the contacts between interfitting spiral elements and the axial contacts between the axial end surface of each spiral element with the inner end surface of the end plate of the other scroll. The volume of the fluid pocket is thereby defined by both line contacts and axial contacts.

The scroll is generally formed from a single piece of metal by a machining process, such as milling. However, a milling process consumes a great deal of time and energy and, also produces large quantities of waste metal. If the scroll member is formed by casting or forging, and axial dimension of the spiral elements is to be made relatively long to obtain a large volume of higher capacity, the draft angle of mold must be made large. After forming in such a mold, the amount of machining of the spiral element to obtain uniform wall thickness increases with the result that relatively large quantities of waste metal are produced. Such a manufacturing method also consumes a great deal of time and energy and, makes it difficult to attain high accuracy of the wall dimensions of the spiral element.

SUMMARY OF THE INVENTION

It is a primary object of this invention to provide an improvement in a manufacturing method of a preformed scroll which is used in a scroll type fluid displacement apparatus.

It is another object of this invention to provide a manufacturing method of the preformed scroll which can reduce the production of waste metal during the finish machining operation of the scroll.

It is further a primary object of this invention to provide a manufacturing tool for forming a preformed scroll which is used in a scroll type fluid displacement apparatus.

It is another object of this invention to provide a manufacturing tool which achieves dimensional accuracy in the finish machining operation on the scroll in a time efficient manner.

A method for manufacturing a scroll for use in a scroll type fluid displacement apparatus according to this invention includes providing one molding member which has two involute grooves extending from one of its side surfaces. The axial cross-sectional configuration of the first involute groove is wedge-shaped and the axial cross-sectional configuration of the second involute groove is substantially rectangular-shaped.

An insertion member with wedge-shape mating cross-section is placed within the first involute groove to fill the space of the groove. A molten metal, which is to form the spiral element of the scroll, fills the second involute groove.

After the metal forms or hardens at the second groove, the insertion member is removed from the first involute groove and the formed metal is removed from the second involute groove. The scroll with rectangular cross-section spiral element is thereby attained.

Another aspect of this invention is to provide another second molding member which has a circular indentation at its axial end surface. The second molding member is secured on the end surface of first molding member to cover both involute grooves. The space of the indentation comprises a forming space. The metal which fills this forming space of the indentation forms the end plate of preformed scroll.

Still another aspect of this invention is that the first molding member has a plurality of holes each of which is placed on the locus of involute curve of the first groove. The holes connect between the bottom surface of first involute groove and opposite side surface of the end plate of first molding member. The insertion member has a plurality of pins at its axial end surface. When the insertion member is placed in the first involute groove, each of the pins penetrates each hole of the first molding member and the axial outer end portion of the pin extends from the hole. The insertion member is, therefore, easily removed from the first involute groove by pushing on the pins.

A manufacturing tool for use in the method of forming the scroll includes a first molding member which has an end plate and two involute wall elements. The two involute wall elements generally extend parallel to one another, so that two involute grooves are defined between the two involute wall elements. One of the two involute grooves has a wedge-shaped axial cross-sectional configuration and, the other involute groove has a substantially rectangular-shaped axial cross-sectional configuration. An insertion member is removably placed within one of two involute grooves. A second molding member has a circular indentation at one side surface facing the involute wall elements. The second molding member is placed on the first molding member and connected to the first molding member when casting of the molten metal occurs.

During molding of the metal, the rectangular-shaped groove in which the molten metal is disposed cannot expand, therefore, the formed or hardened metal which forms the spiral element of preformed scroll keeps the rectangular-shaped sectional configuration.

Another aspect of this invention is that a plurality of holes are formed in the end plate of first molding member and, a plurality of pins which axially project from the insertion member penetrate the holes. The removal of the insertion member is, therefore, easily accomplished by pushing the pins.

Further objects, features and other aspects of this invention will be understood from the following detailed description of preferred embodiment of this invention referring to the annexed drawings.

DETAILED DESCRIPTION OF THE PREFERRED EMBODIMENTS

Figure 2:
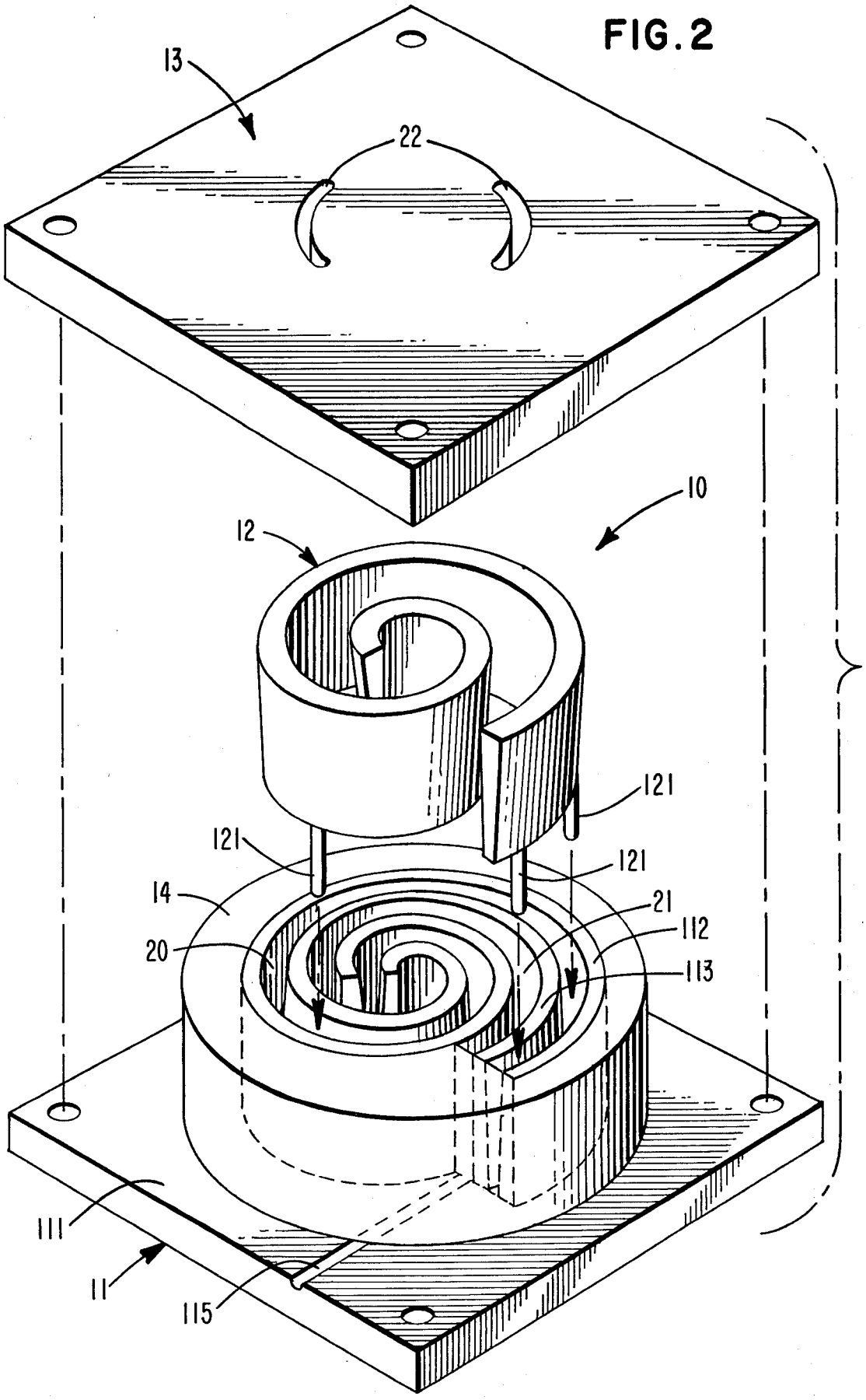
FIG. 2 is an exploded perspective view of the manufacturing tool according to the present invention.
Figure 3:
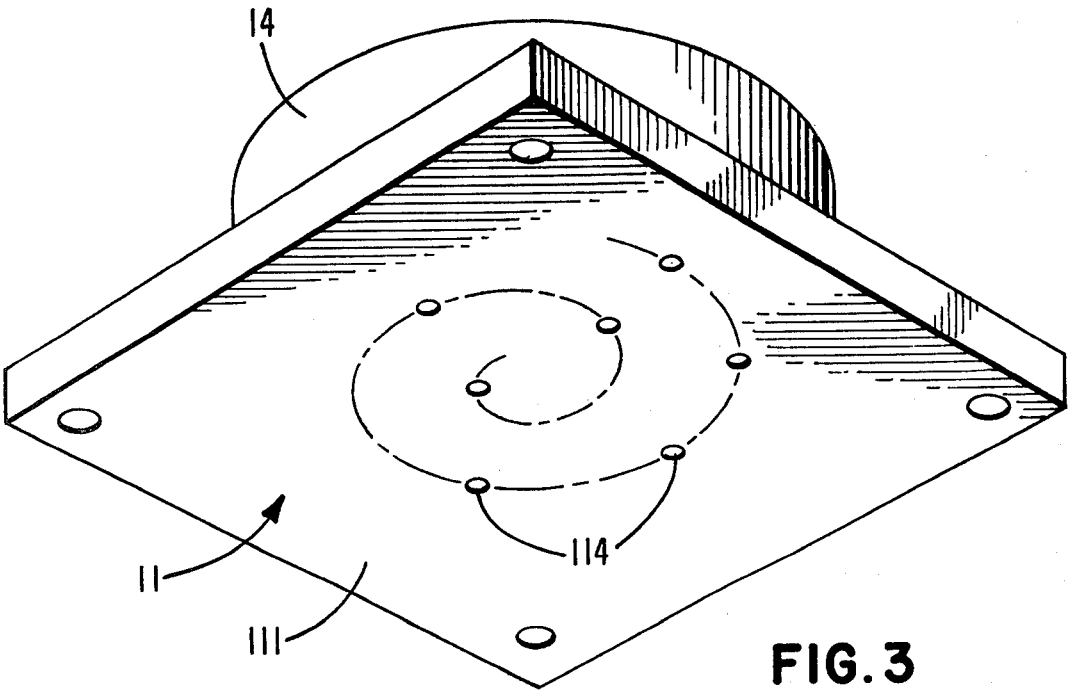
FIG. 3 is a perspective view of the first molding member used in the manufacturing tool of FIG. 2.

Referring to FIG. 2, a manufacturing tool 10 to form a scroll in accordance with the present invention is shown. The tool 10 includes a first molding member 11, an insertion member 12 and, a second molding member 13. First molding member 11 includes an end plate 111 and two involute wall elements 112, 113 affixed to or extending from one side surface of end plate 111. The second involute wall element 113 extends along the inner side surface of first involute wall element 112 with a space between them. Two involute grooves 20, 21 are, thereby, formed between the involute wall elements 112, 113. The outer side surface of first involute wall element 112 forms vertical surface and the inner side surface forms a tapered surface. The outer side surface of second involute wall element 113 also forms a tapered surface and the inner side surface forms vertical surface. An outer involute groove 20 is defined between the inner side surface of first involute wall element 112 and the outer side surface of second involute wall element 113. This outer involute groove 20 has a wedge-shaped axial cross-section with the narrow portion of the wedge-shaped adjacent the end plate 111 and the broad portion of the wedge-shaped adjacent the open end of groove 20. An inner involute groove 21 is defined between the outer side surface of first involute wall element 112 and the inner side surface of second involute wall element 113. The inner involute groove has a substantially rectangular-shape cross-section. A plurality of holes 114 are formed in end plate 111 and extend between the bottom surface of outer involute groove 20 and the opposite side surface of end plate 111. Each hole 114 is placed on the locus of the involute curve which defines outer groove 20, as shown in FIG. 3. A vent hole 115 is also formed through the end surface of end plate 111.

Insertion member 12 is placed in outer groove 20 during the forming of the metal in groove 21. The sectional configuration of insertion member 12 is substantially the same as that of outer groove 20, i.e., wedge-shape. Therefore, the open space of outer groove 20 is filled by insertion member 12. Insertion member 12 has a plurality of pins 121 axially projecting from one of its end surfaces, i.e., the end surface at its narrowed end. Each pin 121 penetrates a hole 114 and preferably the outer end portion of pins 121 extends outward from holes 114.

Figure 4:
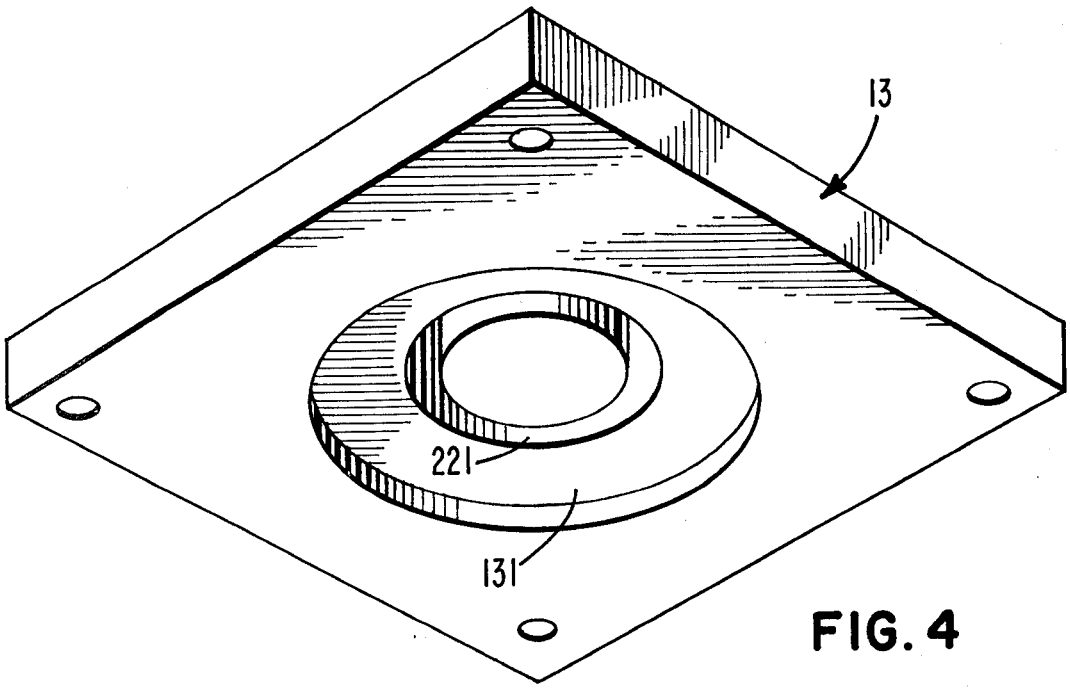
FIG. 4 is a perspective view of the second molding member used in the manufacturing tool of FIG. 2.

Second molding member 13 is placed over the first molding member 11 to close the opening space at the end of involute grooves 20, 21. The end surface of second molding member 13 which faces the first molding member 11 has a circular indentation 131, as shown in FIG. 4. The indentation 131 forms a molding space. A pouring opening 22 is formed through second molding member 13. In this embodiment, as shown in FIG. 2 and FIG. 4, two pouring openings 22 are formed in second molding member 13 and an annular intermediate space 221 connects pouring openings 22 with indentation 131.

In this tool, a supporting member 14 extends from the outer side surface of the first involute wall element 112. When both molding members 11, 13 are connected by a fastener, such as bolts and nuts 15, the axial end surface of supporting member 14 is fitted against the end surface of second molding member 13. The predetermined axial distance between both molding members 11, 13 is, therefore, determined by the length of supporting member 14.

The casting or forging method usng the above tool will be explained below.

As the first step, first molding member 11 and, insertion member 12 are provided. Insertion member 12 is placed in outer involute groove 20 and second molding member 13 is placed on the first molding member 11. Second molding member 13 is then connected to first molding member 11 by bolts and nuts 15.

Molten metal, such as aluminum, is poured into the space defined between both molding members 11, 13 through pouring opening 22. The space of inner groove 21 and molding space of indentation 131 are, therefore, filled with the molten metal which thereafter cools and solidifies.

During this time, the expansion of inner groove 21 due to the filling with and solidification of the molten metal is prevented by insertion member 12 in outer groove 20. Since the sectional configuration of inner groove 21 does not change, the sectional configuration of spiral element of formed scroll has a substantially rectangular-shaped cross-section. Furthermore, the molten metal which fills the molding space of indentation 131 forms the end plate of the scroll.

After solidification of the molten metal, the connection between molding members 11, 13 is released and, second molding member 13 is removed from first molding member 11. The outer end portions of pins 121 of insertion member 12, which extend from holes 114 of the first molding member 11, are then pushed out in the axial direction. Insertion member 12 is, thus, removed from outer groove 20. At the same time, solidified metal, i.e., the preformed scroll, is removed from inner groove 21, since, the axial end surface of insertion member 12 abuts against the end surface of end plate of the preformed scroll which was formed in the molding space of indentation 121. The preformed scroll is thus removed from inner groove 21 of first molding member 11 by removing the insertion member 12. Since the preformed scroll and insertion member 12 are removed from first molding member 11 at the same time, removal of preformed scroll member is readily accomplished. Because the open space of outer groove 20 becomes open during the removal of insertion member 12, involute wall element 112 which forms a partition between the outer and inner grooves can be readily bent, so that the space of the inner groove 21 might become larger.

Figure 1:
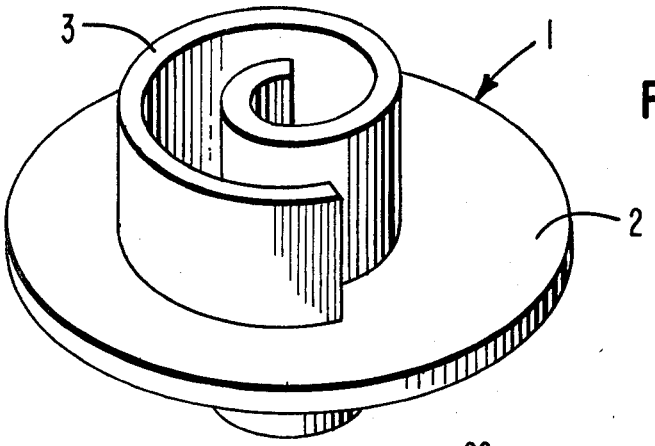
FIG. 1 is a perspective view of a scroll for use in a scroll type fluid displacement apparatus.
Figure 5:
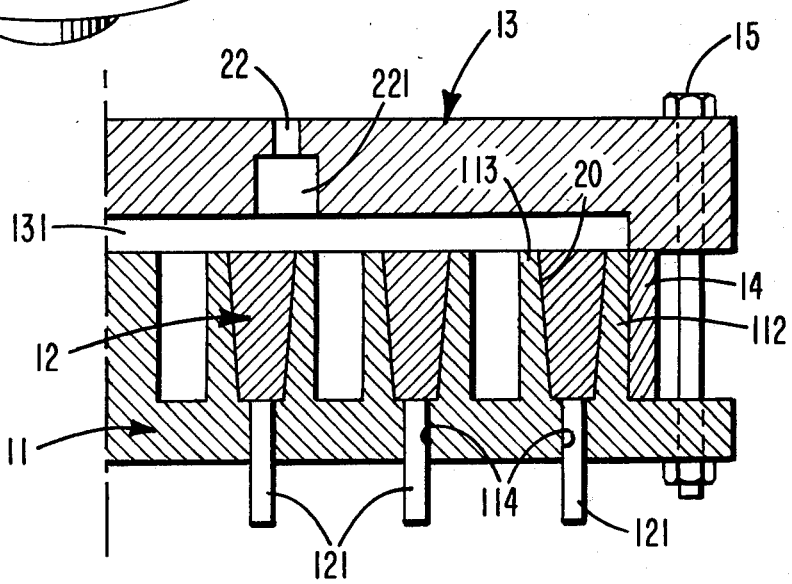
FIG. 5 is a sectional view illustrating a portion of the first and second molding members connected to one another.
Figure 6:
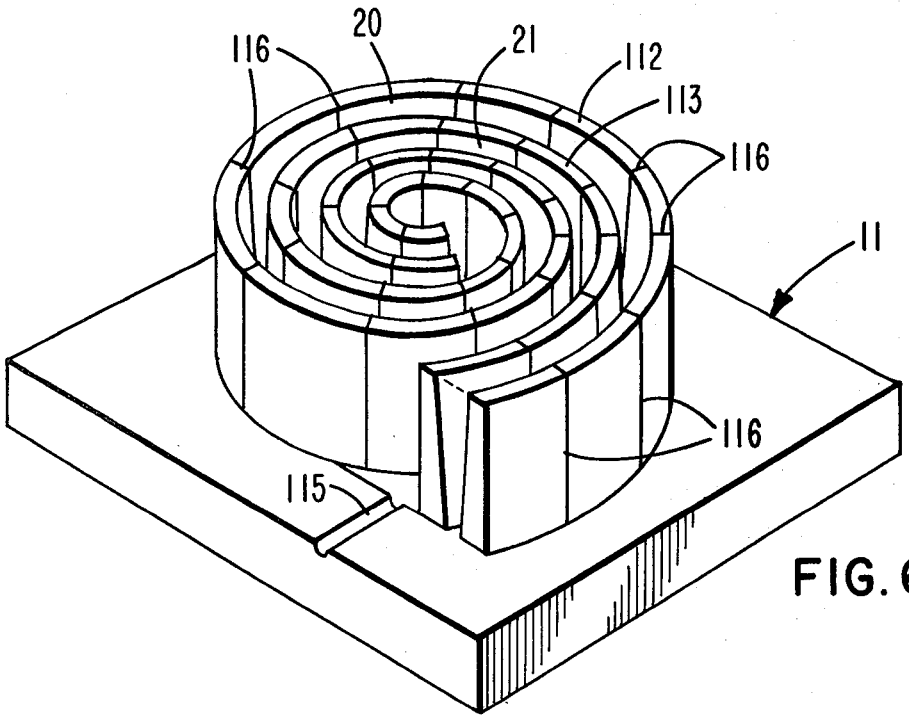
FIG. 6 is a perspective view of the first modling member according to another embodiment of the invention.

FIG. 6 shows another embodiment of manufacturing tool according to this invention, in which the involute wall elements are modified. The first and second involute wall elements 112, 113 have a plurality of slits 116 at predetermined suitable involute angles. Both involute wall elements 112, 113 are thus formed in a plurality of tongue-shaped portions. The removal of the preformed scroll is, therefore, made easier, since, each of tongue-shaped portions of involute wall elements has less rigidity and can be easily bent, however, with better elastic deformation properties so that the wall elements do not deform permanently out of shape.

The preformed scroll formed by above method and tool is machined in a finishing process, such as milling, to produce the final scroll which is used in the scroll type apparatus.

As described above, in this invention, the draft angle of the mold of spiral element portion can be minimized. The production of large quantities of waste metal during the finish working of the preformed scroll is thereby reduced. Furthermore, the time and energy for working of the final scroll is greatly reduced without adversely influencing the accuracy of spiral element dimensions.

This invention has been described in detail in the connection with the preferred embodiment, but this is an example only and the invention is not restricted thereto. It will be easily understood by those skilled in the art that other variations and modifications can be easily made with the scope of this invention.

I claim:

1. A method for manufacturing a scroll for use in a scroll type fluid displacement apparatus, comprising the steps of (a) providing a molding member with a first involute groove having a wedge-shaped axial cross-sectional configuration and a second involute groove having a substantially rectangular-shaped axial cross-sectional configuration and, an insertion member having a wedge-shaped axial cross-sectional configuration mating with the axial cross-sectional configuration of said first involute groove;

(b) inserting said wedge-shaped insertion member into said first involute groove to fill the space within said first groove;

(c) filling the space of said second involute groove with molten metal to form the molten metal into the shape of the spiral element of the scroll with a substantially rectangular axial cross-sectional configuration;

(d) allowing the molten metal in said second involute groove to solidify while preventing the expansion of said second involute groove by the placement of said wedge-shaped insertion member in said first wedge-shaped involute groove; and (e) removing said insertion member from said first involute groove and removing the solidified metal which has been formed into the shape of the spiral element of the scroll from said second involute groove by relative axial movement of said insertion member and said formed spiral element with respect to said involute grooves.

2. The method of claim 1 further including providing another molding member with an end surface having an indentation within which the end plate of the scroll is formed and, said molding member being placed over said first molding member.

3. The method of claim 1 or 2 further including providing a pushing means for contacting the pushing said insertion member to remove said insertion member from said first molding member.

4. The method of claim 1, wherein said metal forming is by a casting process.

5. A method for manufacturing a scroll for use in a scroll type fluid displacement apparatus, comprising the steps of:

(a) providing a molding member having an end plate and two involute wall elements extending from one side surface thereof to define two involute grooves, a first of said grooves having a wedge-shaped axial configuration with the narrow portion of said wedge shape being adjacent said end plate and the broad portion of said wedge shape being adjacent an open end of said two grooves, and a second of said grooves having a generally rectangular-shaped axial cross-sectional configuration;

(b) inserting a mating wedge-shaped insertion member into said first involute groove to fill the space within said first groove;

(c) covering the open end of said first and second grooves with a second molding member, said second molding member having an indentation facing and in communication with said open end of said grooves to define a space within which an end plate of the scroll is formed;

(d) filling the space of said second involute groove and said indentation with molten metal to form the molten metal into the shape of the spiral element of the scroll with a substantially rectangular axial cross-section within said space of said second involute groove and into the shape of the end plate of the scroll within the space of said indentation;

(e) allowing the molten metal in said indentation and said second involute groove to solidify while preventing the expansion of said second involute groove by the placement of said wedge-shaped insertion member in said first wedge-shaped involute groove; and (f) removing said insertion member from said first groove and removing said scroll formed in said second groove and said indentation from said first molding member by relative axial movement of said insertion member and said formed scroll with respect to said involute wall elements.

6. The method of claim 5, wherein said end plate of said first molding member has a plurality of spaced holes located along the locus of the first involute groove, and said insertion member has a plurality of pins extending from its narrow end for insertion into said holes.

7. The method of claim 6, wherein said step of removing said insertion member and said formed scroll includes pushing on said pin to simultaneously remove said insertion member and said formed scroll.

* * * * *